US008851615B2

(12) United States Patent
Ozawa et al.

(10) Patent No.: US 8,851,615 B2
(45) Date of Patent: Oct. 7, 2014

(54) LIQUID EJECTING APPARATUS AND METHOD OF CONTROLLING THE SAME

(75) Inventors: Kinya Ozawa, Shiojiri (JP); Hiroyuki Kuramoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 13/438,748

(22) Filed: Apr. 3, 2012

(65) Prior Publication Data

US 2012/0249639 A1 Oct. 4, 2012

(30) Foreign Application Priority Data

Apr. 4, 2011 (JP) ..... 2011-082512

(51) Int. Cl.
*B41J 29/393* (2006.01)
*B41J 29/38* (2006.01)
*B41J 2/045* (2006.01)

(52) U.S. Cl.
CPC ..... *B41J 2/04581* (2013.01); *B41J 2/04563* (2013.01); *B41J 2/0459* (2013.01)
USPC ..... 347/19; 347/10; 347/17

(58) Field of Classification Search
CPC ..... B41J 2/0454; B41J 2/04563; B41J 29/38
USPC ..... 347/10, 17, 19
See application file for complete search history.

(56) References Cited

U.S. PATENT DOCUMENTS

| | | | | |
|---|---|---|---|---|
| 6,193,351 | B1 | 2/2001 | Yaegashi et al. | |
| 2005/0151815 | A1 | 7/2005 | Kanai et al. | |
| 2009/0322816 | A1 * | 12/2009 | Ihara | 347/14 |
| 2010/0194806 | A1 | 8/2010 | Tanaka | |
| 2011/0261103 | A1 | 10/2011 | Saga et al. | |

FOREIGN PATENT DOCUMENTS

| | | |
|---|---|---|
| CN | 101791905 | 8/2010 |
| JP | 09-207358 | 8/1997 |
| JP | 2010-030313 | 2/2010 |
| WO | 2010-064542 | 6/2010 |

* cited by examiner

*Primary Examiner* — Jason Uhlenhake
(74) *Attorney, Agent, or Firm* — Workman Nydegger

(57) ABSTRACT

A temperature sensor provided to a recording head detects a temperature when the recording head relatively moves outside an opposite region opposite to a platen heater. A driving signal generating circuit compensates an ejection pulse in accordance with the detected temperature.

7 Claims, 9 Drawing Sheets

LIQUID EJECTING APPARATUS AND METHOD OF CONTROLLING THE SAME

BACKGROUND

1. Technical Field

The present invention relates to a liquid ejecting apparatus, such as an ink jet printer, and a method of controlling the same, and more particularly, to a liquid ejecting apparatus including a heating unit that heats a landing target of a liquid to be ejected, and a method of controlling the same.

2. Related Art

A liquid ejecting apparatus is an apparatus which includes a liquid ejecting head that can eject a liquid from nozzles, in which various kinds of liquids are ejected from the liquid ejecting head. A representative liquid ejecting apparatus is an image recording apparatus, such as an ink jet printer (hereinafter, referred to as a printer), which includes an ink jet recording head (hereinafter, referred to as a recording head; otherwise, referred to as a liquid ejecting head ejecting liquid ink). Such a printer records an image or the like by ejecting and impacting liquid ink onto a recording medium, such as a recording sheet, from nozzles of the recording head. In recent years, the liquid ejecting apparatuses are not limited to such an image recording apparatus, and the liquid ejecting apparatus has been applied to various types of manufacturing apparatuses, such as apparatuses for manufacturing color filters such as liquid crystal displays.

In recent years, there is a case in which the printer is used for a purpose of printing a recording medium, for example, outdoor advertisement or the like, larger than the recording medium, such as a print sheet or the like used in a general printer for domestic use. In this instance, weather resistance of the recording is regarded as important, and, for example, a resin film made of vinyl chloride is preferably used. As the ink for use in printing the resin film, there is so-called solvent ink consisting of organic solvent as a main component. The solvent ink is superior in scratch resistance and weather resistance compared with water-soluble ink.

Since the resin film hardly absorbs the ink, the recorded image may blur. In order to cope with such a problem, a configuration for accelerating drying and fixation of the ink impacted onto the recording sheet has been proposed in which a heating unit (platen heater) that heats the recording medium on the platen is provided, and the recording sheet is heated by the heating unit (for example, see JP-A-2010-30313).

However, in the configuration which heats the recording medium by the heating unit, the heat is transmitted from the heating unit to the recording head, and viscosity of the ink varies as time passes. In general, if the temperature inside the recording head is raised, the viscosity of the ink is lowered. If the viscosity of the ink is lowered, the quantity (weight and volume) of the ink is increased when it is ejected at the same pressure. That is, an ejection characteristic is changed in accordance with the temperature. In this way, a concentration of the image printed on the film may be thickened.

In addition, for example, in a case in which the advertisement larger than a recording medium of the maximum size which is printable by the printer is printed, the advertisement which is scheduled for completion can be partially printed on a roll-shaped film, the printed film is cut to divide the respective portions, and then the divided portions are joined to each other, thereby making one sheet of continuous finished product. In the configuration in which the partially printed portions are joined to each other to form one sheet, there is a problem in that a concentration difference at the boundary portion is marked to lead to the deterioration in the image quality. In particular, since the variation in the temperature inside the head is remarkable from the time when the print starts in a low-temperature state of the temperature of the recording head to the time when the temperature of the head arrives at a normal state, such a problem is likely to occur.

SUMMARY

An advantage of some aspects of the invention is to provide a liquid ejecting apparatus and a method of controlling the liquid ejecting apparatus which can suppress a variation in an ejection characteristic in accordance with a variation in a temperature.

According to an aspect of the invention, there is provided a liquid ejecting apparatus including: a recording head provided with a nozzle for ejecting a liquid; a moving unit that moves the recording head relatively; a heating unit that heats a landing target of the liquid to be ejected; a temperature detecting unit that detects a temperature of the recording head; a driving waveform generating unit that generates a driving waveform to drive the recording head; and a liquid ejecting control unit that supplies the driving waveform to the recording head to eject the liquid, wherein the temperature detecting unit detects the temperature of the recording head when the recording head is positioned outside an opposite region, which is opposite to the heating unit, within a moving range of the recording head, and the driving waveform generating unit generates the driving waveform in accordance with the detected temperature.

According to the configuration, since the temperature is detected when the recording head is positioned in the region outside the opposite region, and the driving waveform is compensated in accordance with the temperature, it is possible to reduce the influence of the heat received from the heating of the heating unit at the time of detecting the temperature. For example, it is possible to suppress a variation in a discharge characteristic associated with the temperature change, such as discharge quantity of droplets, discharge velocity, or formation situation of satellite droplets, and it is possible to suppress a variation in the concentration of the image or the like printed as the landing target. In particular, after the heating unit starts to heat the recording head, although the temperature of the recording head is raised, and the detected temperature is abruptly changed, it is possible to prevent the change in color of the image or the like, in spite of the abrupt variation in the temperature, until the temperature arrives at the normal state or at a state close to the normal state.

In addition, if the recording head is positioned in the opposite region, the temperature of the support member may be raised by the heating unit, and thus the temperature of the recording head opposite to the support member may be raised. Accordingly, the temperature to be detected is not constant and is detected unstably, but there is no defect if the temperature is detected outside the opposite region.

It is preferable that the liquid ejecting apparatus further includes a support member that supports the landing target, and the heating unit heats the support member, and the temperature detecting unit detects the temperature of the recording head when the recording head is positioned outside the opposite region, and outside a region opposite to the support member, within the moving range of the recording head.

In this way, since the temperature is detected when the recording head is positioned outside the opposite region and in a region outside the region opposite to the support member in the liquid ejecting apparatus including the configuration capable of heating the support member, it is possible to more reliably suppress the variation in the discharge characteristic.

In the liquid ejecting apparatus, it is preferable that the temperature detecting unit detects the temperature of the recording head when the temperature detecting unit provided to the recording head is positioned outside the opposite region.

In this way, it is possible to suppress the influence of the heat applied to the temperature detecting unit and thus more reliably suppress the variation in the discharge characteristic.

In the liquid ejecting apparatus, it is preferable that the liquid is a liquid of which viscosity is high at a low temperature while the viscosity is low at a high temperature, within a usage temperature range of the liquid ejecting apparatus, and when the temperature detected by the temperature detecting unit is high, the driving waveform generating unit makes an amplitude of the driving voltage narrow, as compared with the driving voltage in a case in which the detected temperature is low.

In this way, it is possible to preferably eject the liquid of which viscosity is inclined to be high at a low temperature, while viscosity is inclined to be low at a high temperature.

In the liquid ejecting apparatus, it is preferable that the temperature detecting unit detects the temperature at a timing when the recording head moves relative to an outside of the opposite region.

In this way, since the driving waveform is compensated whenever the recording head moves relative to the outside of the opposite region, it is possible to more effectively suppress the variation in the ejection characteristic associated with the temperature change.

In the liquid ejecting apparatus, it is preferable that the driving waveform generating unit generates the driving waveform based on a difference between a temperature detected by the temperature detecting unit and a temperature detected at a previous timing.

In this way, it is possible to more effectively suppress the variation in the ejection characteristic associated with the temperature change in accordance with the change in the temperature of the head.

According to another aspect of the invention, there is provided a method of controlling a liquid ejecting apparatus, the method including: the liquid ejecting apparatus including a recording head provided with a nozzle for ejecting a liquid; a moving unit that moves the recording head relatively; a heating unit that heats a landing target of the liquid to be ejected; and a liquid ejecting control unit that supplies a driving waveform to the recording head and ejects the liquid, wherein a temperature of the recording head is detected by a temperature detecting unit mounted to the recording head, when the recording head is positioned outside an opposite region, which is opposite to the heating unit, within a moving range of the recording head, and the driving waveform is generated in accordance with the detected temperature.

In this way, since the driving waveform is compensated in accordance with the temperature detected when the recording head is positioned in the region outside the opposite region, it is possible to reduce the influence of the heat received from the heating of the heating unit at the time of detecting the temperature. For example, it is possible to suppress the variation in the discharge characteristic in accordance with the temperature change, such as discharge quantity of droplets, discharge velocity, or formation situation of satellite droplets.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings. The embodiments are described below with reference to various specific examples, but the scope of the invention should not be construed as being limited to the embodiments described and illustrated herein unless the description clearly states otherwise. Hereinafter, an ink jet printer (hereinafter, referred to as a printer) will be described as an example of a liquid ejecting apparatus. An ink jet printer capable of ejecting ink by a piezoelectric vibrator will be described as an example below, but a liquid ejecting apparatus capable of heating a liquid to boil it and then ejecting ink with its force may be provided. In addition, a recording head does not move toward a platen, but the platen may move toward the recording head.

Figure 1:
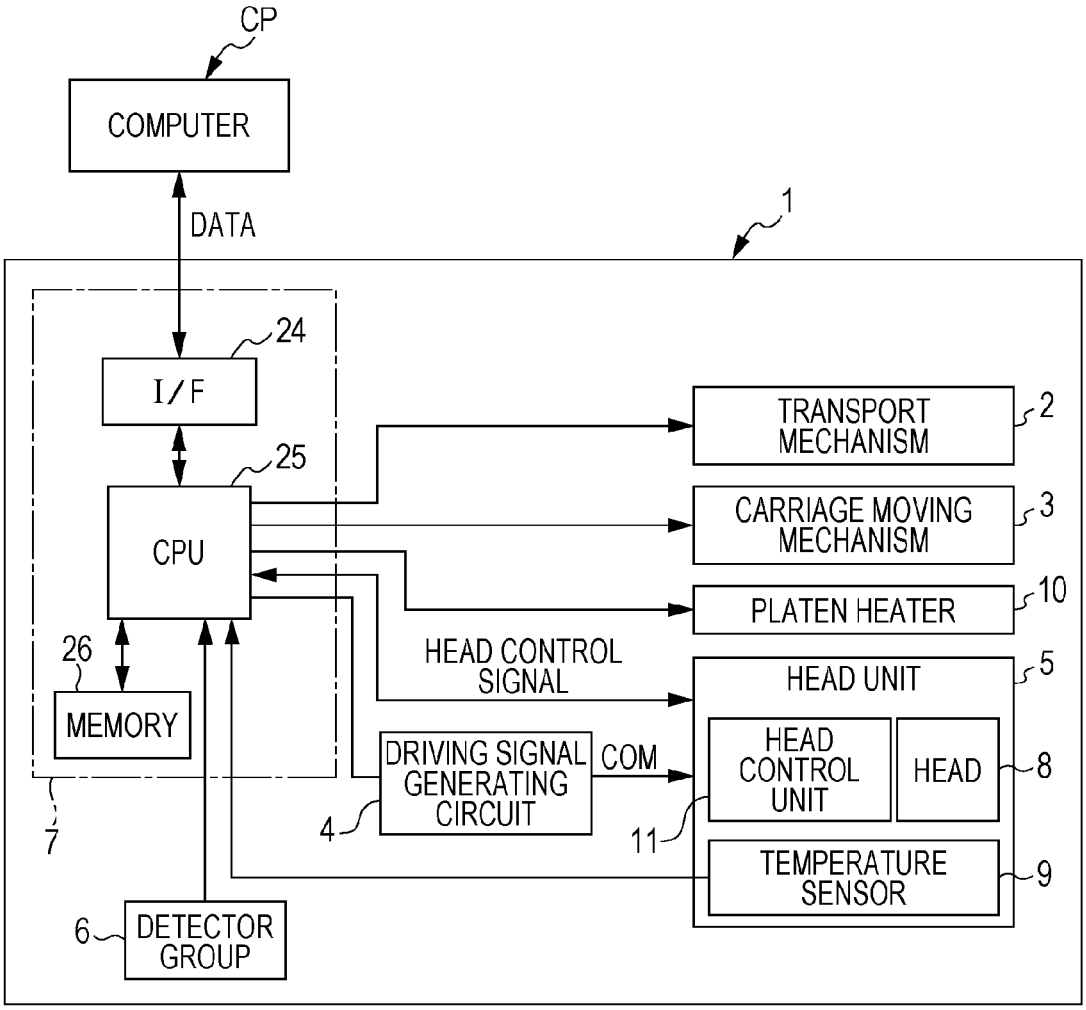
FIG. 1 is a block diagram illustrating an electrical configuration of a printer.
Figure 2A:
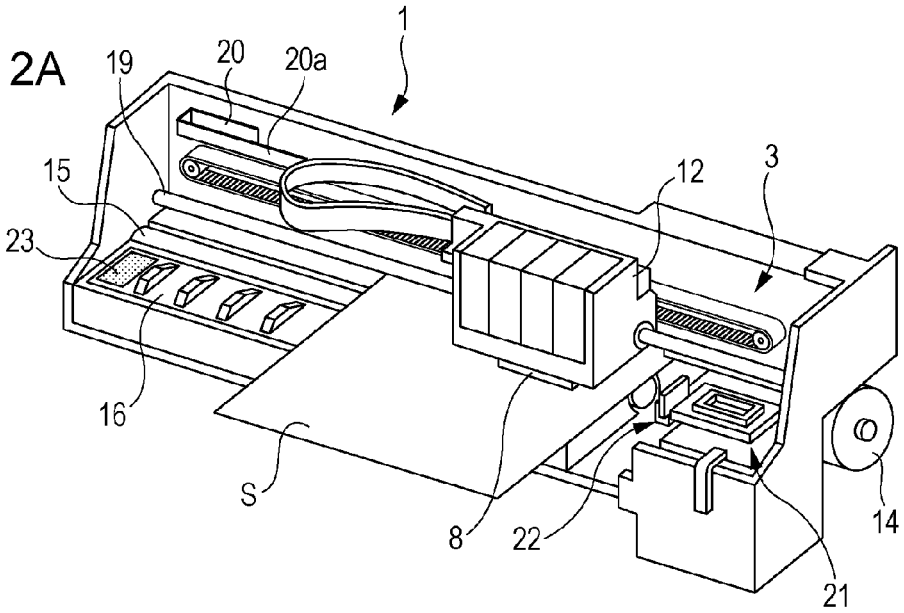
FIG. 2A is a perspective view illustrating an inner structure of a printer.
Figure 2B:
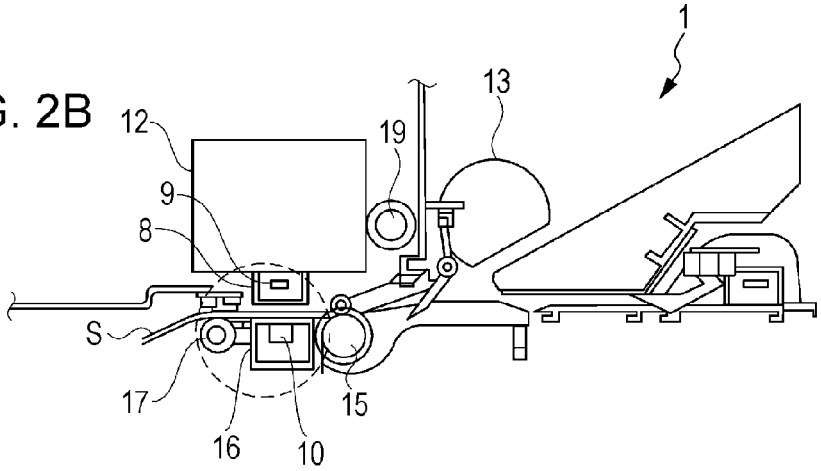
FIG. 2B is a cross-sectional view illustrating an inner structure of a printer.
Figure 2C:
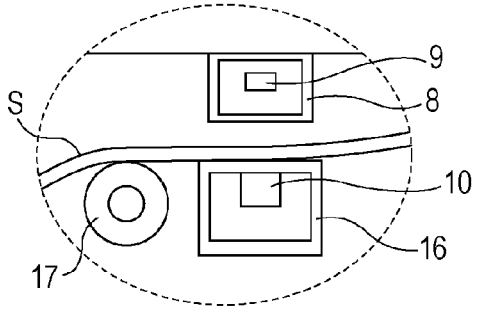
FIG. 2C is an enlarged view of the vicinity of a platen in FIG. 2B.

FIG. 1 is a block diagram illustrating the electric configuration of a printer 1. FIGS. 2A to 2C are diagrams illustrating the inner configuration of the printer 1, in which FIG. 2A is a perspective view thereof, FIG. 2B is a cross-sectional view thereof, and FIG. 2C is an enlarged view of the vicinity of a platen 16 in FIG. 2B.

The exemplary printer 1 ejects ink, which is a kind of liquid, toward a recording medium S such as a recording sheet, a cloth, or a resin film. The recording medium S serves as a landing target which is an object of the liquid to be ejected and impacted. A computer CP serving as an external apparatus is connected to the printer 1 so as to be communicable with the printer 1. The computer CP transmits print data of an image to the printer 1 to instruct the printer 1 to print the image.

Figure 3:
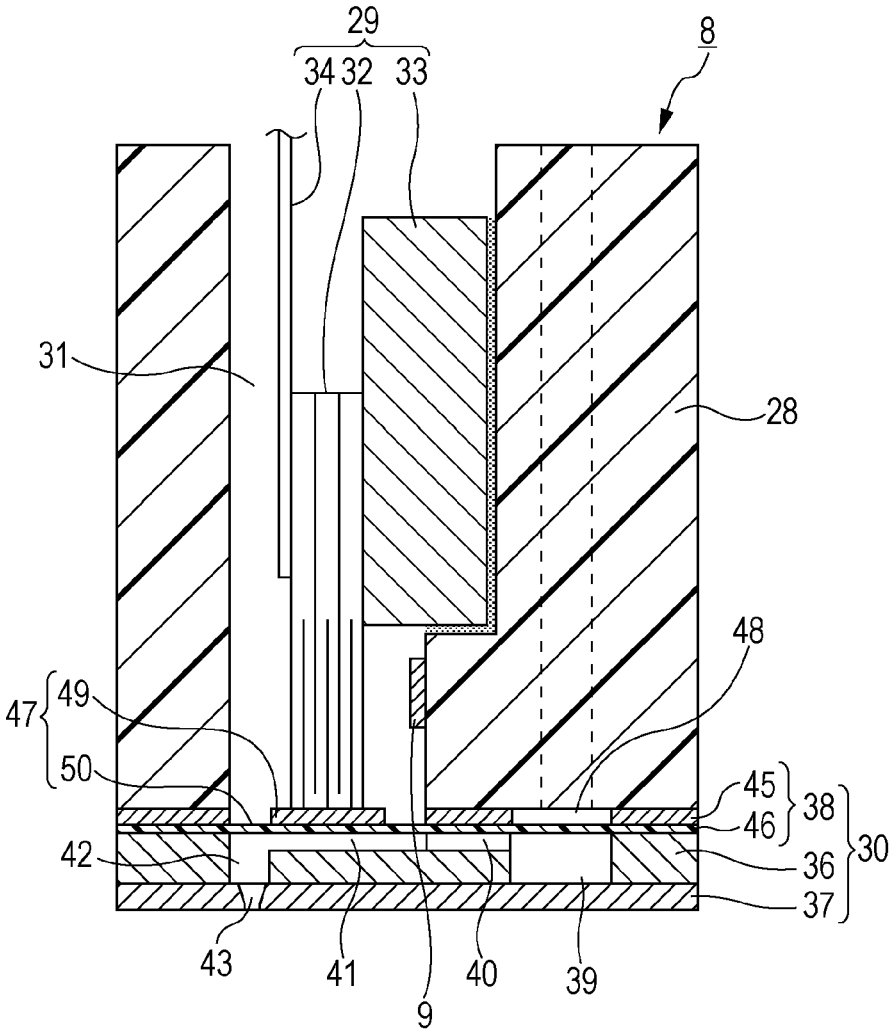
FIG. 3 is a cross-sectional view illustrating a major portion of a recording head.
Figure 4A:
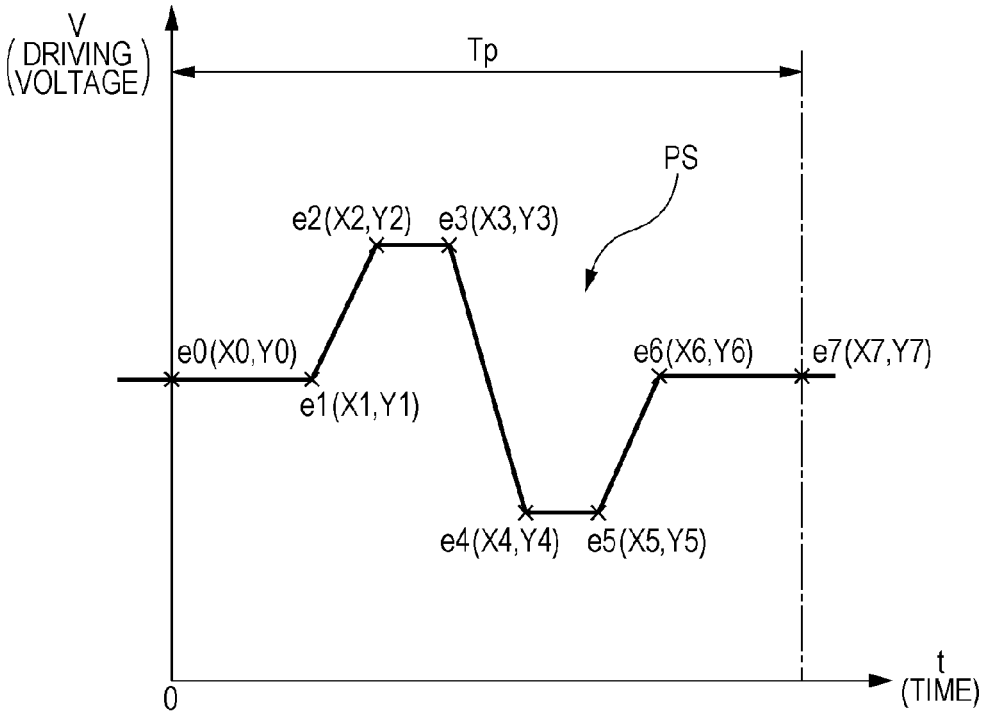
FIGS. 4A and 4B are diagrams illustrating examples of a waveform of an ejection pulse PS included in a driving signal COM.
Figure 4B:
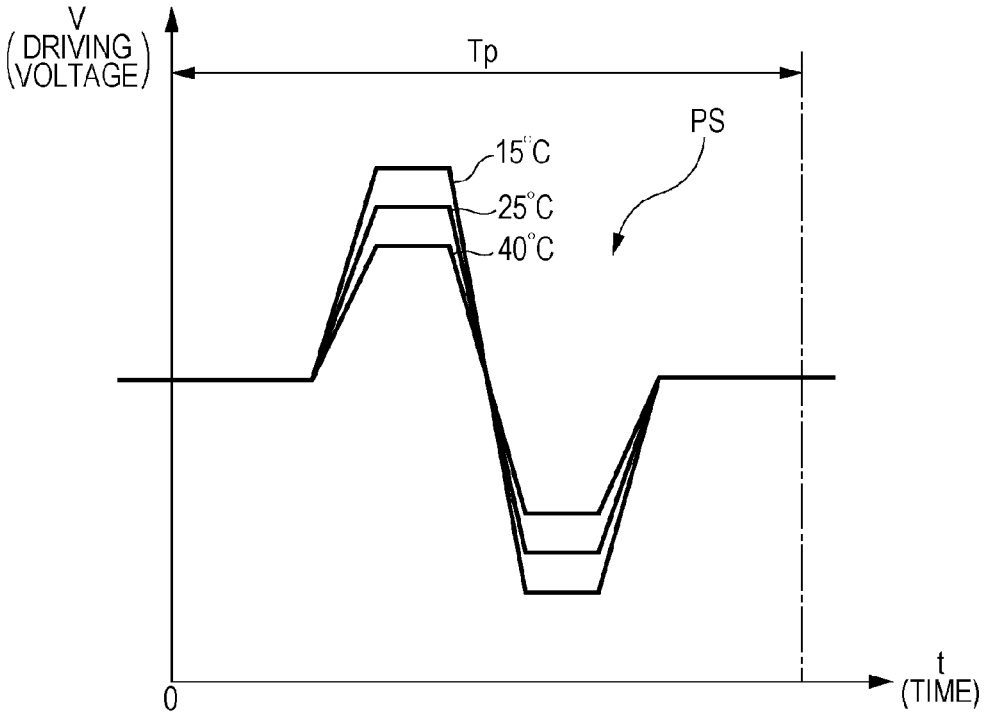

The printer 1 includes a transport mechanism 2, a carriage moving mechanism 3 (moving unit), a driving signal generating circuit 4 (driving waveform generating unit), ahead unit 5, a detector group 6, a printer heat 10, and a printer controller 7 (liquid ejecting control unit). The transport mechanism 2 transports the recording medium S in a transport direction. The carriage moving mechanism 3 moves a carriage, which is mounted with the head unit 5, in a desired moving direction (for example, a sheet width direction). The driving signal generating circuit 4 includes a digital analog converter (DAC, not illustrated), and thus generates an analog voltage signal based on waveform data relevant to a waveform of the driving signal transmitted from the printer controller 7. In addition, the driving signal generating circuit 4 includes an amplifying circuit (not illustrated), and power-amplifies the voltage signal from the DAC to generate a driving signal COM. The driving signal COM (driving waveform) is applied to a piezoelectric vibrator 32 (see FIG. 3) of a recording head 8 at the time of a printing process (recording process or ejecting process) for the recording medium. The driving signal COM is a series of signals including at least one ejection pulse PS in a unit period which is a recurrence period of the driving signal COM, as illustrated in FIGS. 4A and 4B. The ejection pulse PS enables the piezoelectric vibrator 32 to perform a desired operation so as to eject ink of a droplet shape from the recording head 8. The ejection pulse PS will be described in detail below.

The head unit 5 includes the recording head 8, a head control unit 11, and a temperature sensor (temperate detecting unit) 9. The recording head 8 is a kind of a liquid ejecting head, and ejects the ink onto the recording medium and lands it on the recording medium to form dots. The recording head 8 selectively ejects the ink so that the dot stands in a matrix shape, thereby recording an image or the like on the recording medium S. The head control unit 11 controls the recording head 8 based on a head control signal from the printer controller 7. The temperature sensor 9 is a temperature detecting sensor such as a thermistor or a thermocouple, and, as illustrated in FIG. 3, is provided in a receiving hollow portion 31 of a case 28 of the recording head 8. The temperature sensor 9 detects a temperature inside the recording head 8, and outputs the detected signal to a CPU 25 side of the printer controller 7 as temperature information. In addition, the configuration of the recording head 8 will be described in detail below. The detector group 6 includes a plurality of detectors for monitoring the status of the printer 1. The results detected by the detector group are output to the printer controller 7. The printer controller 7 controls the printer 1 on the whole.

The transport mechanism 2 is a mechanism for transporting the recording medium S in a direction (hereinafter, referred to as a transport direction) perpendicular to a scanning direction of the recording head 8. The transport mechanism 2 includes a paper feed roller 13, a transport motor 14, a transport roller 15, a platen (supporting member) 16, and a paper discharge roller 17. The paper feed roller 13 is a roller for feeding the recording medium S inside the printer. The transport roller 15 is a roller for transporting the recording medium S, which is fed by the paper feed roller 13, up to the platen 16 which is a printable area, and is driven by the transport motor 14. The platen 16 supports the recording medium S which is being subjected to the printing. The platen 16 is provided with a platen heater 10 therein. The paper discharge roller 17 is a roller for discharging the recording medium S out away from the printer, and is provided at a downstream side in the transport direction with respect to the printable region. The paper discharge roller 17 rotates in synchronization with the transport roller 15.

The printer controller 7 is a control unit for controlling the printer. The printer controller 7 includes an interface unit 24, a CPU 25, and a memory 26. Between a computer CP which is an external apparatus and the printer 1, the interface unit 24 receives print data or print commands transmitted from the computer CP to the printer 1, and transmits information on the status of the printer 1 to the computer CP. The CPU 25 is an arithmetic processing unit which controls the entire printer. The memory 26 provides an area used to store the programs of the CPU 25, a working area, or the like. The memory 26 includes a storage element such as a random access memory (RAM) or an electrically erasable programmable read-only memory (EEPROM). The CPU 25 controls the respective units in accordance with a program stored in the memory 26.

The platen heater 10 is a device for heating the recording medium S which is passing on the platen 16. The platen heater 10 is connected to the printer controller 7, and is controlled so that the platen heater starts to be simultaneously heated when a power of the printer 1 is turned on, and is heated by a predetermined temperature (for example, 40 to 50° C.). The platen heater 10 is positioned at a position opposite to the recording head 8 described below, and heats the platen 16 to heat the recording medium S passing on the platen 16. In addition, the platen heater 10 corresponds to a heating unit of the invention.

As illustrated in FIGS. 2A to 2C, a carriage 12 is mounted on and axially supported by a guide rod 19 which is installed in a main scanning direction. Therefore, the carriage 12 is adapted to reciprocate in the main scanning direction perpendicular to the transport direction of the recording medium S along the guide rod 19 when the carriage moving mechanism 3 operates. The position of the carriage 12 in the main scanning direction is detected by a linear encoder 20. A signal detected by the linear encoder 20, that is, an encoder pulse (a kind of positional information), is transmitted to the CPU 25 of the printer controller 7. The linear encoder 20 serves as a kind of positional information output unit for outputting the encoder pulse corresponding to the scanning position of the recording head 8 as the positional information on the main scanning direction. The linear encoder 20 according to this embodiment includes a scale (encoder film) 20*a* stretched in the main scanning direction inside the case of the printer 1, and a photo interrupter (not illustrated) installed on the rear surface of the carriage 12. The scale 20*a* may be a band-shaped member made of a transparent resin film, and, for example, opaque stripes crossing in a widthwise direction of the band are printed in plural on the surface of the transparent base film. The respective stripes has the same width, and is formed to have a constant pitch in the longitudinal direction of the band, for example, a pitch corresponding to 180 dpi. The photo interrupter includes a light-emitting element and a light-receiving element facing each other, and is configured to output an encoder pulse corresponding to a difference between a light-received state in the transparent portion of the scale 20*a* and a light-received state in the stripe portion thereof.

Because the stripes are formed in such a manner that the stripes having the same width are running at a constant pitch, an encoder pulse is output at a constant interval when the moving speed of the carriage 12 is constant. However, if the moving speed of the carriage 12 is not constant (during acceleration or deceleration), the interval of the encoder pulses varies depending upon the moving speed of the carriage. The encoder pulse is input to the CPU 25. For this reason, the CPU 25 can recognize the scanning position of the recording head 8 mounted on the carriage 12 based on the received encoder pulse. That is, for example, the position of the carriage 12 can be recognized by counting the received encoder pulses. Thus, the CPU 25 recognizes the scanning position of the carriage 12 (recording head 8) based on the encoder pulse from the linear encoder 20, so that the recording operation can be controlled by the recording head 8.

A home position which becomes a base of the scanning of the carriage is set in an end region (region in front of a right side in FIG. 2A) further outside the recording region in a moving range of the carriage 12. In this embodiment, the home position is provided with a capping member 21 for sealing a nozzle forming surface (a surface of an ejection side of the nozzle plate 37: see FIG. 3) of the recording head 8, and a wiper member 22 for sweeping the nozzle forming surface. The printer 1 may be configured to perform a so-called bidirectional recording process (printing process and injecting process) which records characters, images, or the like on the recording medium S in both directions at forward movement, in which the carriage 12 moves from a home position to an opposite end portion (hereinafter, referred to as a full position), and in the rearward direction, in which the carriage 12 returns from the full position to the home position.

In addition, the printer 1 according to this embodiment moves the recording head 8 onto the capping member 21 at the home position or an upper portion of an ink receiving portion 23 provided on the platen 16 at the full position opposite to the home position during printing, and performs flushing toward the liquid receiving portion in a state in which the nozzle surface faces the capping member 21 or the ink receiving portion 23. The object of the flushing is to recover an ejection characteristic of ink, such as ejection quantity or flying speed, which has deteriorated due to viscosity of the ink or retention of bubbles, to a design target value, thereby forcibly ejecting and removing the thickening ink or bubbles from the nozzles. Accordingly, the flushing corresponds to a process of recovering its ejection performance.

Next, the configuration of the recording head 8 will be described with reference to FIG. 3.

The recording head 8 includes a case 28, a vibrator unit 29 received in the case 28, and a passage unit 30 joined to the bottom surface (front end surface) of the case 28. The case 28 is formed of, for example, epoxy-based resin. A receiving hollow portion 31 is formed inside the case to receive the vibrator unit 29. The vibrator unit 29 includes a piezoelectric vibrator 32 serving as a pressure generation unit, a fixing plate 33 to which the piezoelectric vibrator 32 joins, and a flexible cable 34 supplying a driving signal to the piezoelectric vibrator 32. The piezoelectric vibrator 32 is a laminated type manufactured by cutting a piezoelectric plate, alternatively laminated by piezoelectric layers and electrode layers, in a pectinate form. The vibrator 32 is a vertical vibration mode piezoelectric vibrator expandable and contractible (of electric field lateral effect type) in a direction perpendicular to the lamination direction (electric field direction). In addition, a temperature sensor 9 is installed on an inner wall surface of the case 28 between the fixing plate 33 and a vibration plate 38 in the receiving hollow portion 31.

The passage unit 30 includes a nozzle plate 37 joined to one surface of a passage substrate 36, and the vibration plate 38 joined on the other surface of the passage substrate 36. A reservoir (common liquid chamber) 39, an ink supply port 40, a pressure chamber 41, a nozzle communication opening 42, and nozzles 43 are provided in the passage unit 30. A series of ink passages lead from the ink supply port 40 to each nozzle 43 via the pressure chamber 41 and the nozzle communication opening 42 formed corresponding to each nozzle 43.

The nozzle plate 37 is a member provided with a plurality of nozzles 43 punched in rows at a pitch (for example, 180 dpi) corresponding to a dot formation density. In this embodiment, the nozzle plate 37 is made of, for example, stainless steel. In addition, the nozzle plate 37 may be made of a silicon single crystalline substrate. The vibration plate 38 is a double structure in which an elastic film 46 is laminated on the surface of a support plate 45. This embodiment is made by the vibration plate 38 which is formed as a composite plate member including a stainless plate, which is a kind of metallic plate, as the support plate 45, and a resin film, which is laminated on the surface of the support plate 45, as the elastic film 46. The vibration plate 38 is provided with a diaphragm portion 47 for varying the volume of the pressure chamber 41. Also the vibration plate 38 is provided with a compliance portion 48 for sealing a part of the reservoir 39.

The diaphragm portion 47 is manufactured by partially removing the support plate 45 by an etching process or the like. That is, the diaphragm portion 47 includes an island 49 to which the front end surface of a free end of the piezoelectric vibrator 32 joins, and a thin-walled elastic portion 50 surrounding the island 49. The compliance portion 48 is manufactured by removing the support plate 45 of a region facing the opened surface of the reservoir 39 by an etching process or the like in the same way as the diaphragm portion 47. The compliance portion 48 functions as a damper for absorbing changes in the pressure of liquid stored in the reservoir 39.

Since the front end surface of the piezoelectric vibrator 32 joins to the island 49, the volume of the pressure chamber 41 can be changed by expanding or contracting the free end portion of the piezoelectric vibrator 32. The change in the pressure of the ink in the pressure chamber 41 is caused with the variation in the volume. The recording head 8 ejects ink droplets from the nozzles 43 using the change in the pressure.

FIGS. 4A and 4B are diagrams illustrating a waveform example of the ejection pulse PS included in the driving signal COM generated by the driving signal generating circuit 4. The driving signal COM is repeatedly generated by the driving signal generating circuit 4 for every unit period which is a repeat period. The unit period corresponds to a period while the nozzle 43 is moved by a distance corresponding to one pixel of an image or the like printed on the recording medium S. For example, in a case in which print resolution is 720 dpi, a unit period T corresponds to a period in which the nozzle 43 is moved by 1/720 inch with respect to the recording medium S. The unit period includes at least one period Tp, in which the ejection pulse PS is generated. That is, the driving signal COM includes at least one ejection pulse PS. In addition, the waveform of the ejection pulse PS is not limited to the illustrated one, but various kinds of waveforms may be employed depending upon the quantity or the like of the ink ejected from the nozzle 43.

FIG. 4A illustrates coordinates e0 to e7 at each point of the waveform of the ejection pulse PS. When the driving signal COM is generated, the printer controller 7 outputs coordinate data (time and voltage), in which the waveform of the driving signal is defined by coordinates of a time and a voltage. That is, in the coordinate data, X indicates an elapsed time when e0 is set to an origin, while Y indicates a voltage corresponding to the time. The driving signal generating circuit 4 interpolates the interval between coordinate points based on the transmitted coordinate data to generate a waveform of a driving signal in which the coordinates of the coordinate data are combined. Accordingly, if each piece of coordinate data transmitted from the printer controller 7 is varied, the waveform of the ejection pulse is also varied.

For example, when the amplitude of the ejection pulse is increased, a value of the voltage Y2 in e2 and a value of the voltage Y3 in e3 are set to be high, and a value of the voltage Y4 in e4 and a value of the voltage Y5 in e5 are set to be low. Thereby, since the amplitude of the ejection pulse is increased, a displacement of the piezoelectric vibrator 32 to be applied is further increased. In addition, when the amplitude of the ejection pulse is lower, the value of the voltage Y2 in e2 and the value of the voltage Y3 in e3 are set to be low, and the value of the voltage Y4 in e4 and the value of the voltage Y5 in e5 are set higher. Thereby, since the amplitude of the ejection pulse is decreased, the displacement of the piezoelectric vibrator 32 to be applied is further decreased. It is possible to generate a desired ejection pulse. In addition, it is possible to change a slope of the potential variation without changing the voltage. For example, by making the value of the time X1 in e1 bigger or making the value of the time X4 in e4 smaller, the slope of the potential variation can be steep. Accordingly, the displacement of the piezoelectric vibrator 32 to be applied becomes even steeper. By contrast, by making the value of the time X1 in e1 smaller and making the value of the time X4 in e4 larger, the slope of the potential variation can be gradual. Accordingly, the displacement of the piezoelectric vibrator 32 to be applied becomes further gradual.

By the way, the viscosity of the ink used in this embodiment is changed depending upon the temperature. If the viscosity of the ink is low, it is helpful for the nozzle to eject the ink droplets. If the viscosity of the ink is high, it is difficult for the nozzle to eject the ink droplets. Accordingly, if the temperatures of the inks are different from each other, the ejection quantity of the ink droplets is different even in a case in which the same driving signal (ejection pulse) is applied to the piezoelectric vibrator 32. Specifically, even in the case in which the ejection pulse of the same waveform is applied to the piezoelectric vibrator 32, if the temperature is high, the ink droplets of larger size than that of the ink droplets when the temperature is low are ejected. If the ejection quantity of the ink droplets are varied depending upon the temperature, the concentration of the image formed on the recording medium S is changed depending upon the temperature. In the printer 1 according to this embodiment, since the platen heater 10 starts to be heated simultaneously with the supply of the power source, the heat is transmitted from the platen heater 10 to the recording head 8, so that the viscosity of the ink is changed, specifically, the viscosity is lowered.

Figure 5:
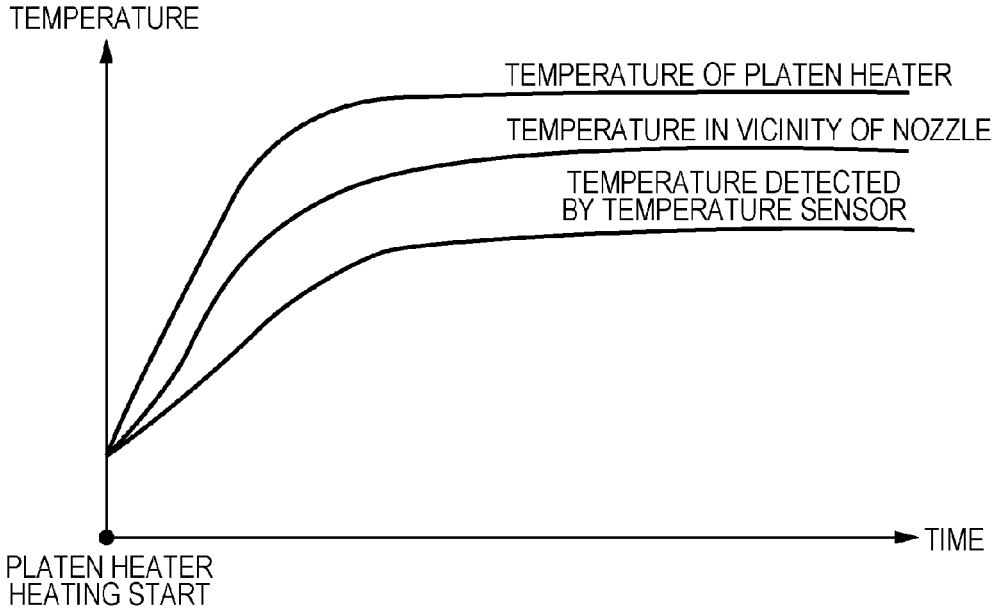
FIG. 5 is a graph illustrating a change in a temperature of a platen heater, a temperature in the vicinity of a nozzle of a recording head, and a temperature detected by a temperature sensor.

FIG. 5 is a graph illustrating the change in the temperature of the platen heater 10, the temperature in the vicinity of the nozzle of the recording head 8, and the temperature detected by the temperature sensor 9 when the power of the printer 1 is turned on. As illustrated in the drawing, due to the heat of the platen heater 10, the temperature inside the recording head 8 is raised in a relatively low-temperature state when the power is input, as time passes. In addition, in the configuration in which the temperature sensor 9 is placed at a position far away from the nozzle 43, the temperature of the ink in the vicinity of the nozzle 43 is inclined to be higher than the temperature detected by the temperature sensor 9. Since the viscosity of the ink is significantly changed until the temperature (the temperature detected by the temperature sensor 9) inside the recording head 8 arrives at the normal state, the concentration of the image is likely to be changed.

As described above, in order to prevent the problem in that the concentration of the image is likely to be changed by the heat from the platen heater 10, when the recording head 8 moves towards the outside rather than a region (hereinafter, referred to as an opposite region) opposite to the platen heater 10 within the scanning range of the recording head 8, the printer 1 according to this embodiment is adapted to detect the temperature inside the head by use of the temperature sensor 9 and compensate the ejection pulse PS included in the driving signal COM generated from the driving signal generating circuit 4 in accordance with the detected temperature.

Figure 6:
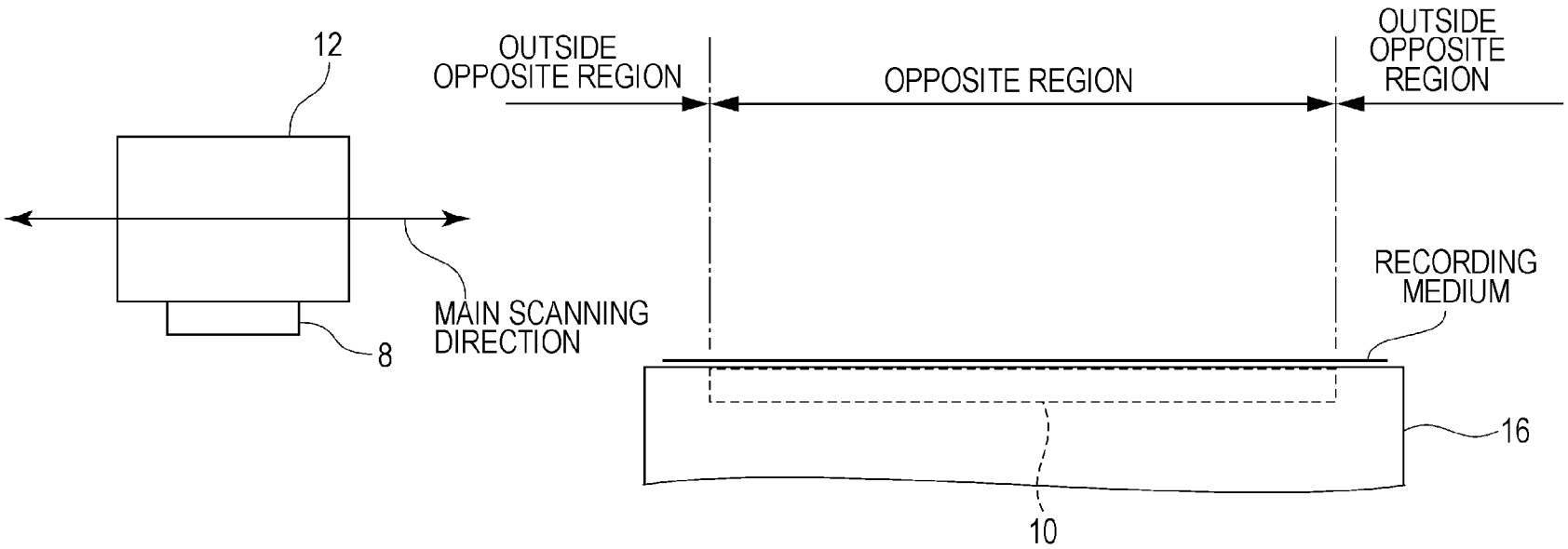
FIG. 6 is a diagram illustrating a positional relationship between a recording head and a platen heater.

FIG. 6 illustrates a positional relationship between the recording head 8 and the platen heater 10 in the main scanning direction (widthwise direction of the paper) of the recording head 8. As shown in FIG. 6, in the case in which the recording head 8 is positioned in the opposite region, which is opposite to the range in which the platen heater 10 is installed, within the scanning range of the recording head 8, the recording head is likely to be heated by the influence of the heat from the platen heater 10. That is, in the case in which the recording head 8 is positioned in the opposite region, a part of the heat from the platen heater 10 is transmitted to the recording head 8, and has an influence on the temperature detected by the temperature sensor 9 installed on the recording head 8. In particular, in the case in which the placement position of the temperature sensor 9 installed on the recording head 8 is within the range of the opposite region, the temperature detection by the temperature sensor 9 is likely to be affected by the heat of the platen heater 10.

Figure 7:
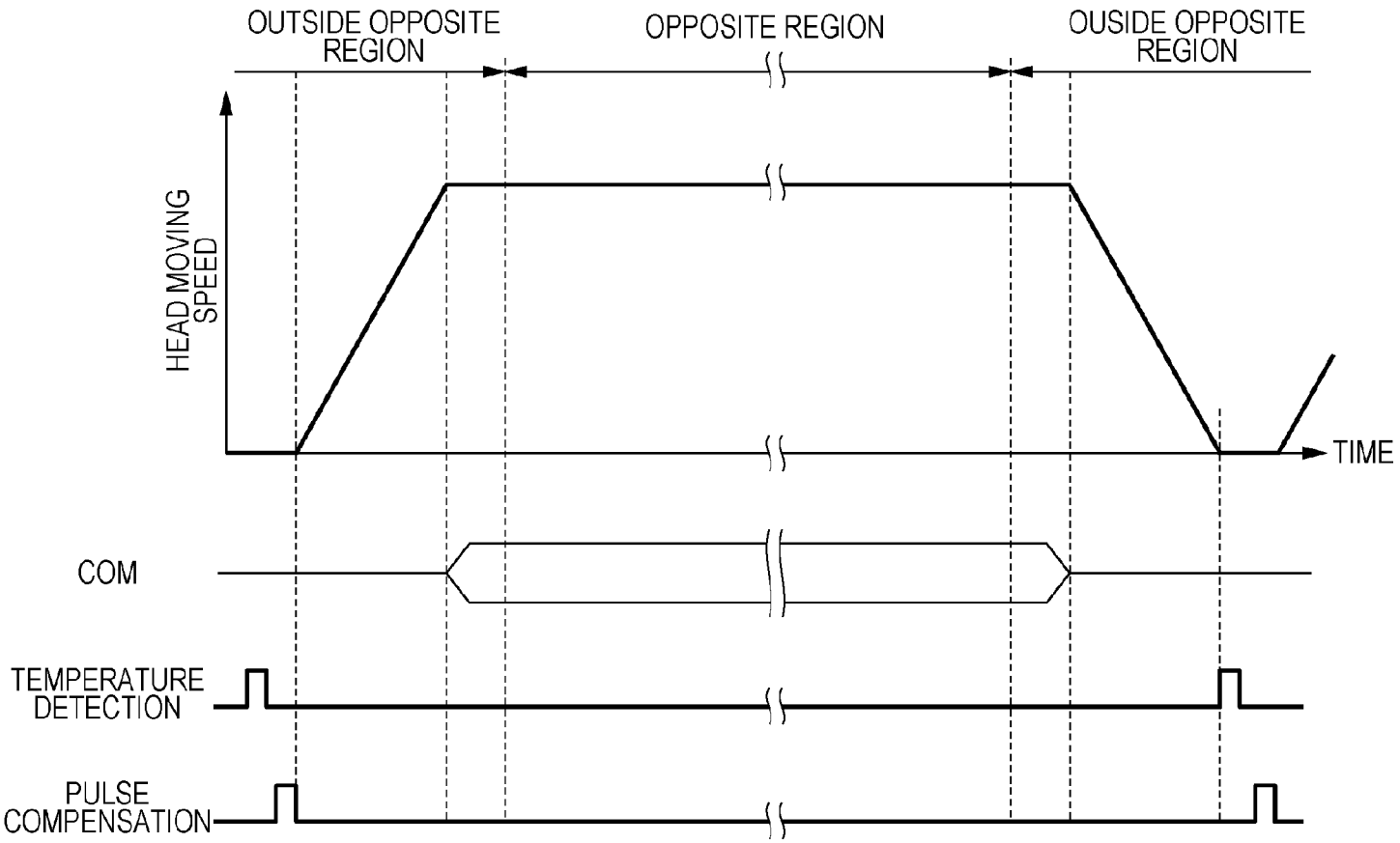
FIG. 7 is a timing chart corresponding to a timing of the respective processes of generating a driving signal COM, detecting a temperature, and compensating a pulse with respect to a head moving velocity.

FIG. 7 is a timing chart illustrating a timing of the respective processes of generating the driving signal COM, detecting the temperature, and compensating the pulse in accordance to the moving velocity of the recording head 8 to show the one-way scanning of the recording head 8. In addition, FIG. 7 illustrates a rectangular pulse at the timing of the temperature detecting process and the pulse compensating process. When the printing operation starts, the recording head 8 waiting in the home position starts to move toward the full position side. Acceleration until the recording head 8 arrives at a constant velocity is completed outside the opposite region. While the recording head 8 moves at a constant velocity in the opposite region, that is, the region opposite to the platen heater 10, the recording head applies the ejection pulse PS included in the driving signal COM to the piezoelectric vibrator 32 based on the print data, so that the ink is ejected from the nozzles 43 to print the image or the like on the recording medium S. If the recording head 8 moves outside the opposite region, the ejection operation is stopped, and the recording head 8 is decelerated. When the moving direction is switched in a reverse direction, the moving velocity becomes 0 temporarily, and the movement of the recording head stops.

The temperature detection by the temperature sensor 9 is carried out whenever the recording head 8 moves out of the opposite region (that is, usually from an end to an end in a main scanning direction) until the detected temperature arrives at the normal state. In this embodiment, the temperature is detected by the temperature sensor 9 at the time when the recording head 8 stops so as to switch the moving direction outside the opposite region (otherwise, at the time when the recording head seems to stop). The temperature detection is carried out at the timing when the movement of the recording head 8 stops, thereby preventing a noise from being superimposed over the detected signal. Accordingly, it is possible to detect the accurate temperature. In addition, a noise associated with the vibration generated when the recording head 8 moves (when the platen 16 moves in a case in which the position of the recording head 8 is stationary and the platen 16 is movable), or a noise from a motor of the carriage moving mechanism 3 is considered as the noise superimposed over the signal detected by the temperature sensor 9. Accordingly, such an influence can be prevented by detecting the temperature at the time when the recording head 8 stops outside the opposite region. In addition, in a case in which the recording head 8 is positioned in the opposite region, and the temperature of the platen 16 heated by the platen heater 10 is raised, the temperature of the recording head 8 opposite to the platen 16 is also raised. Therefore, the temperature to be detected is not constant and thus is unstably detected, but such a defect is prevented as the recording head is outside the opposite region (otherwise, a place which is not opposite to the platen 16).

However, the temperature detection is not limited to the time when the movement of the recording head 8 stops, but the temperature can be detected at a timing of slow speed as compared with the moving velocity within the opposite region until the recording head 8 again enters the opposite region through deceleration, stop and acceleration so as to switch the direction out of the opposite direction.

As the temperature is detected by the temperature sensor 9, the ejection pulse PS is compensated (otherwise, initial set at the time of starting the print) in accordance with the detected temperature until the recording head 8 again enters the printing region. The memory 26 of the printer controller 7 is stored with a compensation equation for defining variations of the coordinates e0 to e7 on the respective points of waveform elements forming the ejection pulse PS with respect to the temperature detected by the temperature sensor 9. That is, the ejection pulse PS generated by the driving signal generating circuit 4 is compensated at the next printing operation based on the detected temperature and the compensation equation, and the driving signal generating circuit 4 generates the driving signal including the compensated ejection pulse PS at the next printing operation.

FIG. 4B is a diagram illustrating the ejection pulse PS which is changed in accordance with the temperature detected by the temperature sensor 9. In the drawing, an ejection pulse PS generated when the detected temperature is 15° C., an ejection pulse PS generated when the detected temperature is 25° C., and an ejection pulse PS generated when the detected temperature is 40° C. are illustrated. The use temperature range of the printer 1 is 5° C. to 45° C. As illustrated in the drawing, the amplitude of the ejection pulse PS at a temperature (25° C.) higher than this is narrow as compared with the amplitude of the ejection pulse PS at a low temperature (15° C.). The amplitude at 40° C. is further narrow. For solvent-based ink, since its viscosity is lowered if the temperature is raised within its use temperature range, it is preferable to make the amplitude of the driving voltage narrow accordingly. That is, as the temperature detected by the temperature sensor 4 is high, the driving signal generating circuit 9 serving as the driving waveform generating unit decreases the driving voltage of the ejection pulse PS to make the amplitude narrow. The driving signal generating circuit 4 generates the driving signal COM including the ejection pulse in accordance with the detected temperature.

As described above, the temperature detection and the compensation of the ejection pulse are carried out whenever the recording head 8 moves out of the opposite region until the temperature detected by the temperature sensor 9 is in the normal state (otherwise, a state close to the normal state). Even though the viscosity of the liquid is changed depending upon the variation in the temperature and the driving pulse is the same, it is possible to suppress the ejection quantity of the liquid from being varied. As a result, the concentration of the image or the like printed on the recording medium S is suppressed to be varied. In particular, after the printer 1 is input with the power to start to heat the platen heater 10 and before the temperature of the platen heater 10 or recording head 8 arrives at the normal state, it is possible to prevent the change in color of the image or the like, in spite of the abrupt variation in the temperature, until the detected temperature arrives at the normal state even when the abrupt variation in the temperature occurs. For example, in a case in which advertisement or the like is partially printed on the recording medium such as a resin film, and then each portion is finally joined to make one sheet of continuous advertisement, it is possible to reduce the difference in the concentration of the image at the boundary portion of the respective portions.

In order to detect the temperature at an outside of the opposite region, the temperature detection and the change of the driving signal (driving waveform) according to the detected temperature can be quickly carried out, and thus print spots can be decreased. The temperature detection and the compensation of the ejection pulse may be carried out whenever the recording head 8 moves out of the opposite region after the temperature detected by the temperature sensor 9 is in the normal state or is close to the normal state. For example, it is preferable to thin the interval by carrying out the temperature detection and the pulse compensation only when the recording head 8 moves out of the opposite side of the home position side. In addition, in regard to the compensation of the ejection pulse PS based on the temperature detected by the temperature sensor 9, it is preferable to assume the temperature in the vicinity of the nozzle from the temperature detected by the temperature sensor 9 and then compensate the ejection pulse PS based on the assumed temperature.

Furthermore, a new driving waveform may be generated in a case in which a difference between the temperature detected at the outside of the opposite region and the temperature detected at the previous timing is higher than a predetermined value (for example, 1° C.), while the same driving waveform as last time may be continuously used, in a case in which the temperature difference is smaller than a designated value. In this way, since a preferred discharge characteristic can be obtained and the times of changing the driving waveform can be suppressed, it is possible to reduce the burden on the driving circuit or the noise generated from the circuit.

Next, a second embodiment will be described. In the above-described first embodiment, the temperature of the recording head 8 is detected and then the driving waveform is compensated, when the recording head 8 is positioned outside the opposite region opposite to the platen heater 10. However, in the second embodiment, a region opposite to a drying heater for drying the ink impacted onto the recording medium is regarded as an opposite region, and the temperature of the recording head 8 is detected and then the driving waveform is compensated, when the recording head 8 is positioned outside the opposite region. In addition, the same configuration of the second embodiment as that of the first embodiment will be not described herein.

Figure 8:
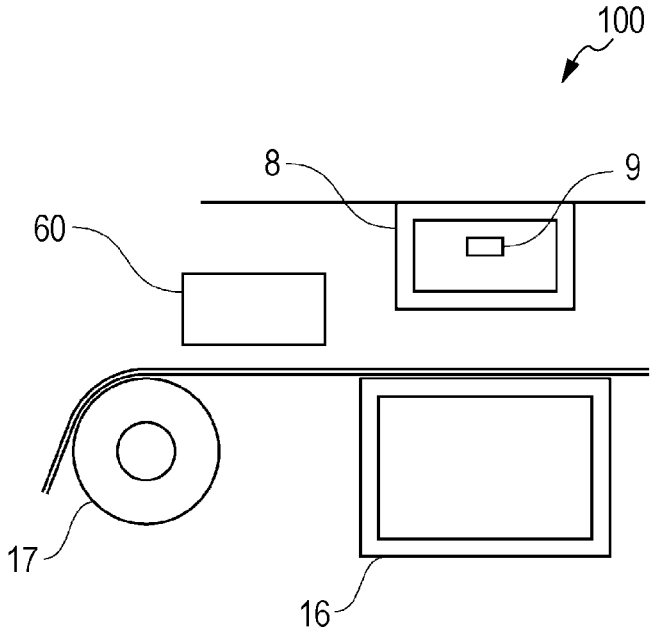
FIG. 8 is a diagram illustrating the configuration of a printer according to a second embodiment in the vicinity of a platen.
Figure 9:
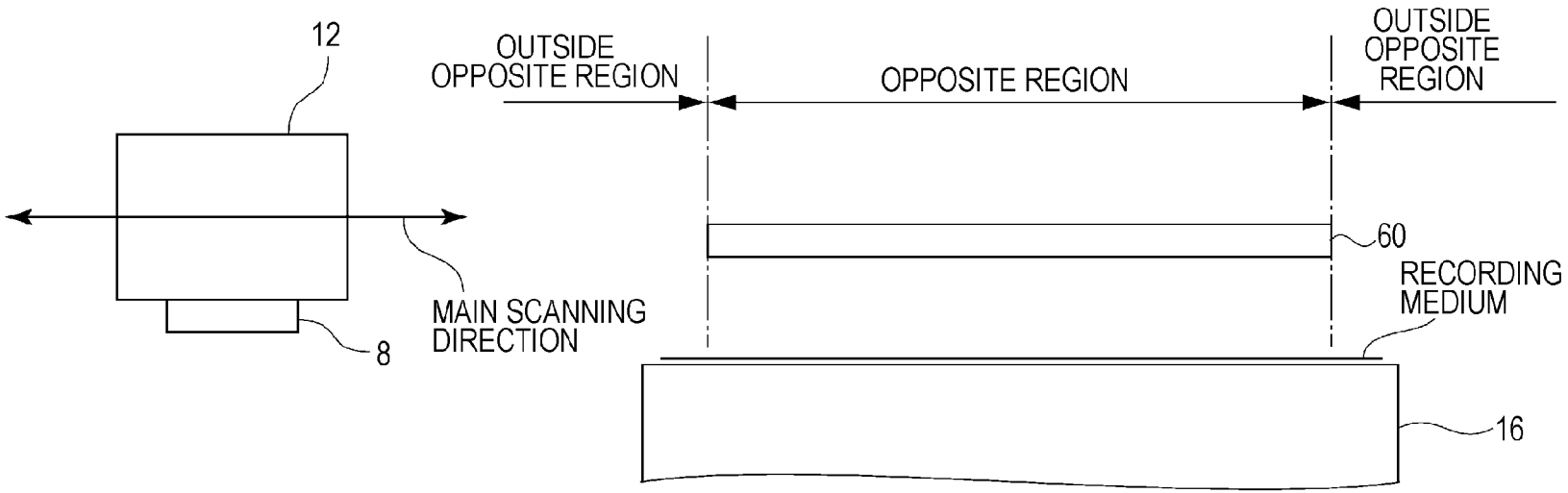
FIG. 9 is a diagram illustrating a positional relationship between a recording head and a heater.

FIG. 8 is a diagram illustrating a configuration in the vicinity of a platen of a printer according to the second embodiment. As illustrated in FIG. 8, a printer 100 includes a drying heater 60 for drying the ink landed onto the recording medium at a downstream side than the recording head 8 in a transport direction of the recording medium and at the recording head 8 side rather than the recording medium. In this configuration, the region opposite to the region heated by the drying heater 60 is regarded as the opposite region, as illustrated in FIG. 9. In the second embodiment, when the recording head 8 moves outside the opposite region, the temperature inside the head is detected by the temperature sensor 9, and the ejection pulse PS included in the driving signal COM generated from the driving signal generating circuit 4 is compensated in accordance with the detected temperature. Accordingly, even though the viscosity of the liquid is changed depending upon the variation in the temperature which is caused by the influence of the heat from the heater 60 and the driving pulse is the same, it is possible to suppress the ejection quantity of the liquid from being varied. As a result, the concentration of the image or the like printed on the recording medium S is suppressed to be varied.

The invention is not limited to the above-described embodiments, but may be modified in various forms within the scope of the claims of the invention.

In the first embodiment, the region opposite to the platen heater 10 is regarded as the opposite region, and the temperature is detected outside the opposite region. However, it is possible to detect the temperature outside the region opposite to the platen 16. In this way, the heat transmitted from the platen heater 10 to the platen 16 is further transmitted to the recording head 8, thereby suppressing the influence on the discharge characteristic.

The printer including the recording head 8 provided with the temperature sensor 9 has been described in each embodiment, but the position provided with the temperature sensor 9 is not limited thereto. For example, the temperature sensor may be installed to a carriage having the recording head 8.

Each embodiment illustrates an example in which the temperature detection and the pulse compensation are carried out at the timing when the recording head 8 stops in the out of opposite region, the invention is not limited thereto. The temperature detection or the like may be carried out in a state in which the recording head 8 moves. In this instance, it is preferable to maintain a low-velocity state as slow as possible in order to suppress a noise from being superimposed over the detected signal.

In the above-described embodiments, the so-called vertical vibration type piezoelectric vibrator 32 is used as the pressure generation unit, but the invention is not limited thereto. For example, a so-called bending vibration piezoelectric element may be used. In this case, waveforms inverted in a change direction of potential, that is, a vertical direction are used for the ejection pulses PS exemplified in the above-described embodiments.

The pressure generation unit is not limited to the piezoelectric element. The invention is applicable even when various kinds of pressure generation units, such as a heating element, generating bubbles in a pressure chamber, or an electrostatic actuator, changing the volume of a pressure chamber using an electrostatic force, are used.

As described above, the ink jet printer 1 which is a kind of liquid ejecting apparatus has been described as an example. However, the invention is applicable to any liquid ejecting apparatus which includes a heating unit heating an object to be landed and ejects a liquid while a recording head and a landing target are relatively moved. For example, the invention is applicable to a display manufacturing apparatus which manufactures a color filter such as a liquid crystal display, an electrode manufacturing apparatus which manufactures an electrode such as an organic EL (electro luminescence) display or an FED (field emission display), a chip manufacturing apparatus which manufactures a bio chip (bio-chemical chip), a micropipette which supplies a very small amount of a sample solution exactly, and the like.

The entire disclosure of Japanese Patent Application No. 2011-082512, filed Apr. 4, 2011 is expressly incorporated by reference herein.

What is claimed is:

1. A liquid ejecting apparatus comprising:

a recording head provided with a nozzle for ejecting a liquid;

a moving unit that moves the recording head relatively;

a heating unit that heats a landing target of the liquid to be ejected;

a temperature detecting unit that detects a temperature of the recording head;

a driving waveform generating unit that generates a driving waveform to drive the recording head; and a liquid ejecting control unit that supplies the driving waveform to the recording head to eject the liquid, wherein the temperature detecting unit begins to detect the temperature of the recording head when the recording head moves outside an opposite region such that temperature detection occurs when the recording head stops movement outside of the opposite region, which is opposite to the heating unit, within a moving range of the recording head, and the driving waveform generating unit generates the driving waveform in accordance with the detected temperature.

2. The liquid ejecting apparatus according to claim 1, further comprising:

a support member that supports the landing target, wherein the heating unit heats the support member, and the temperature detecting unit detects the temperature of the recording head when the recording head is positioned outside the opposite region, and outside a region opposite to the support member, within the moving range of the recording head.

3. The liquid ejecting apparatus according to claim 1, wherein the temperature detecting unit detects the temperature of the recording head when the temperature detecting unit provided to the recording head is positioned outside the opposite region.

4. The liquid ejecting apparatus according to claim 1, wherein the liquid is a liquid of which viscosity is high at a low temperature while the viscosity is low at a high temperature, within a usage temperature range of the liquid ejecting apparatus, and when the temperature detected by the temperature detecting unit is high, the driving waveform generating unit makes an amplitude of the driving voltage narrow, as compared with the driving voltage in a case in which the detected temperature is low.

5. The liquid ejecting apparatus according to claim 1, wherein the temperature detecting unit detects at a timing when the recording head moves relative to an outside of the opposite region.

6. The liquid ejecting apparatus according to claim 5, wherein the driving waveform generating unit generates the driving waveform based on a difference between a temperature detected by the temperature detecting unit and a temperature detected at a previous timing.

7. A method of controlling a liquid ejecting apparatus, the method comprising:

the liquid ejecting apparatus including a recording head provided with a nozzle for ejecting a liquid;

a moving unit that moves the recording head relatively;

a heating unit that heats a landing target of the liquid to be ejected; and a liquid ejecting control unit that supplies a driving waveform to the recording head and ejects the liquid, wherein a temperature detecting unit begins to detect the temperature of the recording head when the recording head moves outside an opposite region such that temperature detection occurs when the recording head stops movement outside of the opposite region, which is opposite to the heating unit, within a moving range of the recording head, and the driving waveform is generated in accordance with the detected temperature.

* * * * *